US010862254B2

(12) United States Patent
Komoto

(10) Patent No.: US 10,862,254 B2
(45) Date of Patent: Dec. 8, 2020

(54) COATED CONDUCTIVE WIRE CONNECTING METHOD, COATED CONDUCTIVE WIRE CONNECTING STRUCTURE AND COATED CONDUCTIVE WIRE CONNECTING MEMBER

(71) Applicant: Japan Aviation Electronics Industry, Limited, Tokyo (JP)

(72) Inventor: Tetsuya Komoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/717,686

(22) Filed: Dec. 17, 2019

(65) Prior Publication Data

US 2020/0235536 A1 Jul. 23, 2020

(30) Foreign Application Priority Data

Jan. 22, 2019 (JP) ..... 2019-008473

(51) Int. Cl.

| | |
|---|---|
| ***H01R 27/02*** | (2006.01) |
| ***A41D 1/00*** | (2018.01) |
| ***H01R 4/48*** | (2006.01) |
| ***H01R 12/67*** | (2011.01) |

(52) U.S. Cl.

CPC ..... *H01R 27/02* (2013.01); *A41D 1/005* (2013.01); *H01R 4/4818* (2013.01); *H01R 12/67* (2013.01)

(58) Field of Classification Search

CPC ..... H01R 27/02; H01R 12/67; H01R 4/4818; H01R 12/78; H01R 12/79; A41D 1/005

See application file for complete search history.

(56) References Cited

U.S. PATENT DOCUMENTS 4,314,095 A * 2/1982 Moore ..... A61N 1/05 174/840

4,990,724 A * 2/1991 Suppelsa ..... H05K 1/118 174/261

(Continued)

FOREIGN PATENT DOCUMENTS

JP 2012-234688 11/2012

*Primary Examiner* — Briggitte R. Hammond

(74) *Attorney, Agent, or Firm* — Muncy, Geissler, Olds & Lowe, P.C.

(57) ABSTRACT

A coated conductive wire connecting method includes: making an end of a sheet-type conductive member accommodated in a sheet-type conductive member accommodating portion through a sheet-type conductive member insertion opening of a housing; holding a coated conductive wire by a coated conductive wire holding portion of the housing; and making a pressure contact terminal accommodated in a pressure contact terminal accommodating portion whereupon an edge of a terminal-side slit cuts and tears an insulating part of the coated conductive wire to electrically connect the pressure contact terminal to a conductor part of the coated conductive wire, while a spring contact of the pressure contact terminal elastically deformed passes over a step portion formed within the housing and elastically presses the sheet-type conductive member against an inner wall surface of the sheet-type conductive member accommodating portion to electrically connect the pressure contact terminal to the sheet-type conductive member.

9 Claims, 8 Drawing Sheets

(56) References Cited

U.S. PATENT DOCUMENTS 5,675,888 A * 10/1997 Owen ..... H01R 43/205
29/829
6,139,353 A * 10/2000 Muz ..... H01R 4/2433
439/417
6,638,090 B2 * 10/2003 Wakata ..... H01R 13/521
439/135

* cited by examiner

COATED CONDUCTIVE WIRE CONNECTING METHOD, COATED CONDUCTIVE WIRE CONNECTING STRUCTURE AND COATED CONDUCTIVE WIRE CONNECTING MEMBER

BACKGROUND OF THE INVENTION

The present invention relates to a coated conductive wire connecting method, particularly to a method of connecting a coated conductive wire to a sheet-type conductive member.

The present invention also relates to a coated conductive wire connecting structure and a coated conductive wire connecting member.

In recent years, attention has been drawn to so-called smart clothes that can collect user's biological data such as the heart rate and the body temperature only by being worn by the user. Such smart clothes are equipped with a sheet-type conductive member using conductive fiber, conductive printing or the like, and for instance, when the sheet-type conductive member is electrically connected to a measurement device placed outside of the smart clothes through a coated conductive wire, this makes it possible to send detected biological data to the measurement device.

The connection between the sheet-type conductive member and the coated conductive wire as above may be established also by soldering; however, when a material of the clothes has low heat resistance, soldering is not applicable.

To cope with it, for example, JP 2012-234688 A discloses a connecting member used to connect a coated conductive wire to a sheet-type conductive member without soldering.

The connecting member disclosed by JP 2012-234688 A is configured such that a flat first member 3 for holding cloth 2 having plural conductive yarns 1 woven therein and a flat second member 5 for holding a coated conductive wire 4 are joined by a hinge portion 6, as shown in FIG. 29. The first member 3 includes a conductive portion 7 formed in a planar shape and plural projections 8 being in electrical continuity with the conductive portion 7 and projecting from the conductive portion 7, while the second member 5 has a groove 9 receiving the coated conductive wire 4 therein.

First, the projections 8 of the first member 3 are caused to penetrate the end portion of the cloth 2 to thereby hold the end portion of the cloth 2 on the conductive portion 7 of the first member 3, and the conductive yarns 1 exposed from the end portion of the cloth 2 are extended over the groove 9 in the second member 5.

In this state, the coated conductive wire 4 is inserted into the groove 9 of the second member 5 from above the conductive yarns 1, so that the conductive yarns 1 are sandwiched between the coated conductive wire 4 and the inner surface of the groove 9.

Subsequently, as shown in FIG. 30, the first member 3 and the second member 5 are folded at the hinge portion 6 to superpose the second member 5 on the conductive portion 7 of the first member 3, whereupon the cloth 2 and the conductive yarns 1 are sandwiched and fixed between the first member 3 and the second member 5, and the conductive yarns 1 make electrical continuity with the conductive portion 7 of the first member 3. In addition, the projections 8 of the first member 3 penetrate an insulator part of the coated conductive wire 4 inserted in the groove 9 of the second member 5 and come into contact with a conductor part of the coated conductive wire 4 to thereby establish their electrical continuity. Thus, the coated conductive wire 4 is electrically connected to the conductive yarns 1.

In the connecting member disclosed by JP 2012-234688 A, however, connecting the coated conductive wire 4 to the conductive yarns 1 woven in the cloth 2 is a complicated and burdensome task.

SUMMARY OF THE INVENTION

The present invention has been made to overcome the conventional problems as above and aims at providing a coated conductive wire connecting method that makes it possible to readily connect a coated conductive wire to a sheet-type conductive member.

The present invention also aims at providing a coated conductive wire connecting structure obtained by use of the coated conductive wire connecting method, as well as a coated conductive wire connecting member for use in the coated conductive wire connecting method.

A coated conductive wire connecting method according to the present invention comprises:

placing an end of a sheet-type conductive member such that the end of the sheet-type conductive member is accommodated in a sheet-type conductive member accommodating portion in an insulating housing through a sheet-type conductive member insertion opening formed at one end of the housing;

holding a coated conductive wire by a coated conductive wire holding portion disposed on another end side of the housing; and placing a pressure contact terminal made of metal and including a flat portion which extends parallel to the sheet-type conductive member and in which a terminal-side slit is formed and a spring contact disposed to be elastically deformable in a direction perpendicular to the flat portion, such that the pressure contact terminal is accommodated in a pressure contact terminal accommodating portion communicating with the sheet-type conductive member accommodating portion within the housing, through a pressure contact terminal insertion opening formed at the another end of the housing, whereupon the coated conductive wire held by the coated conductive wire holding portion is inserted into the terminal-side slit, and an edge of the terminal-side slit cuts and tears an insulating part of the coated conductive wire to electrically connect the pressure contact terminal to a conductor part of the coated conductive wire, while the spring contact elastically deformed passes over a step portion formed in a communicating part between the pressure contact terminal accommodating portion and the sheet-type conductive member accommodating portion within the housing and elastically presses the sheet-type conductive member against an inner wall surface of the sheet-type conductive member accommodating portion to electrically connect the pressure contact terminal to the sheet-type conductive member.

A coated conductive wire connecting structure according to the present invention comprises:

an insulating housing in which a sheet-type conductive member insertion opening is formed at one end of the housing, a pressure contact terminal insertion opening is formed at another end of the housing and a sheet-type conductive member accommodating portion communicating with the sheet-type conductive member insertion opening and a pressure contact terminal accommodating portion communicating with the pressure contact terminal insertion opening are formed inside the housing, the sheet-type conductive member accommodating portion and the pressure contact terminal accommodating portion communicating with each other, a step portion being formed in a communicating part between the sheet-type conductive member accommodating portion and the pressure contact terminal accommodating portion, a coated conductive wire holding portion for holding a coated conductive wire being disposed on a side of the another end of the housing; and a pressure contact terminal made of metal and including a flat portion in which a terminal-side slit is formed and which extends parallel to a sheet-type conductive member and a spring contact disposed to be elastically deformable in a direction perpendicular to the flat portion, wherein an end of the sheet-type conductive member is accommodated in the sheet-type conductive member accommodating portion through the sheet-type conductive member insertion opening of the housing, wherein the coated conductive wire is held by the coated conductive wire holding portion of the housing, wherein the pressure contact terminal is accommodated in the pressure contact terminal accommodating portion through the pressure contact terminal insertion opening of the housing with the spring contact being elastically deformed, wherein an insulating part of the coated conductive wire inserted into the terminal-side slit of the pressure contact terminal is cut and torn by an edge of the terminal-side slit, whereby the pressure contact terminal is electrically connected to a conductor part of the coated conductive wire, and wherein the sheet-type conductive member accommodated in the sheet-type conductive member accommodating portion is elastically pressed against an inner wall surface of the sheet-type conductive member accommodating portion by the spring contact positioned beyond the step portion in the housing, whereby the pressure contact terminal is electrically connected to the sheet-type conductive member.

A coated conductive wire connecting member according to the present invention comprises:

an insulating housing in which a sheet-type conductive member insertion opening is formed at one end of the housing, a pressure contact terminal insertion opening is formed at another end of the housing, and a sheet-type conductive member accommodating portion communicating with the sheet-type conductive member insertion opening and a pressure contact terminal accommodating portion communicating with the pressure contact terminal insertion opening are formed inside the housing, the sheet-type conductive member accommodating portion and the pressure contact terminal accommodating portion communicating with each other, a step portion being formed in a communicating part between the sheet-type conductive member accommodating portion and the pressure contact terminal accommodating portion, a coated conductive wire holding portion for holding a coated conductive wire being disposed on a side of the another end of the housing; and a pressure contact terminal made of metal and including a flat portion in which a terminal-side slit is formed and which extends parallel to a sheet-type conductive member and a spring contact disposed to be elastically deformable in a direction perpendicular to the flat portion, the pressure contact terminal being configured to be accommodated in the pressure contact terminal accommodating portion through the pressure contact terminal insertion opening of the housing with the spring contact being elastically deformed, wherein, with an end of the sheet-type conductive member being accommodated in the sheet-type conductive member accommodating portion through the sheet-type conductive member insertion opening of the housing, and the coated conductive wire being held by the coated conductive wire holding portion of the housing, when the pressure contact terminal is accommodated in the pressure contact terminal accommodating portion, the coated conductive wire is inserted into the terminal-side slit of the pressure contact terminal, and an insulating part of the coated conductive wire is cut and torn by an edge of the terminal-side slit, whereby the pressure contact terminal is electrically connected to a conductor part of the coated conductive wire, while the sheet-type conductive member accommodated in the sheet-type conductive member accommodating portion is elastically pressed against an inner wall surface of the sheet-type conductive member accommodating portion by the spring contact positioned beyond the step portion in the housing, whereby the pressure contact terminal is electrically connected to the sheet-type conductive member.

DETAILED DESCRIPTION OF THE INVENTION

Embodiments of the present invention are described below based on the appended drawings.

Embodiment 1

Figure 1:
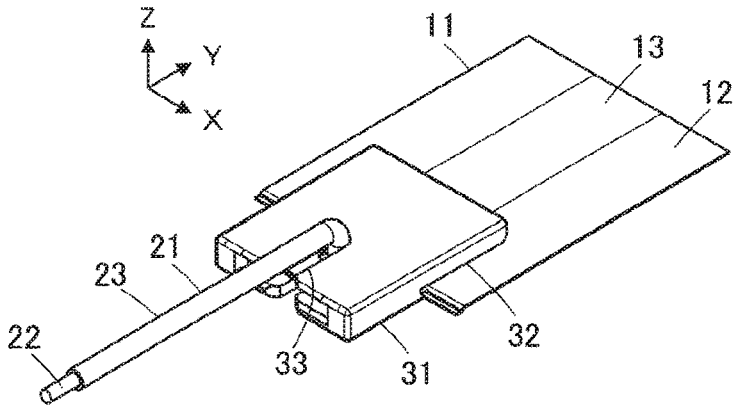
FIG. 1 is a perspective view showing a coated conductive wire connecting structure according to Embodiment 1.
Figure 2:
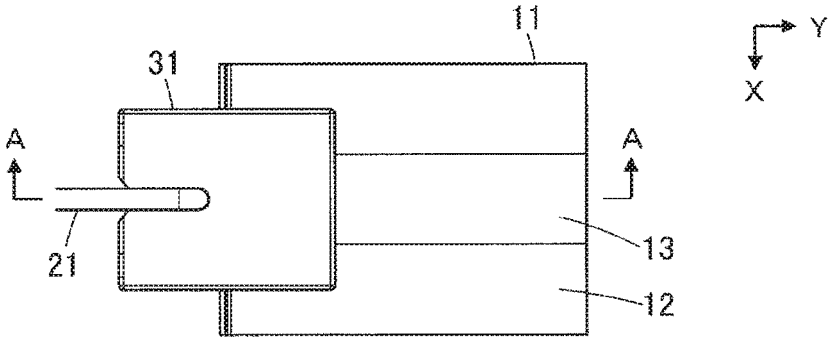
FIG. 2 is a plan view showing the coated conductive wire connecting structure according to Embodiment 1.
Figure 3:
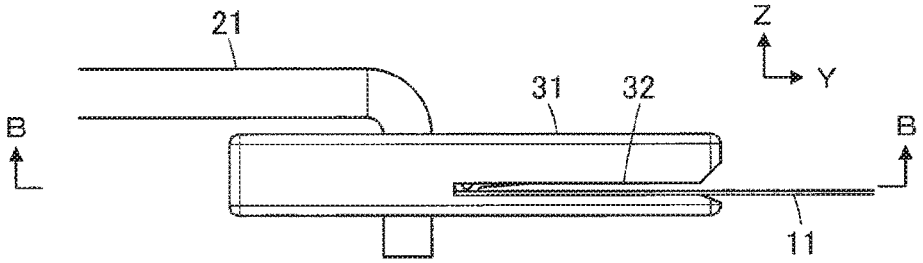
FIG. 3 is a side view showing the coated conductive wire connecting structure according to Embodiment 1.

FIGS. 1 to 3 show a coated conductive wire connecting structure according to Embodiment 1. The coated conductive wire connecting structure is provided to connect a coated conductive wire 21 to a sheet-type conductive member 11 and includes an insulating housing 31. The sheet-type conductive member 11 includes an insulating sheet body 12 that is a piece of cloth, a resin film or the like, and a conductive pattern 13 formed on a surface of the sheet body 12. The coated conductive wire 21 has such a structure that the outer periphery of a conductor part 22 is covered with an insulator part 23.

The housing 31 is in a flat plate shape extending parallel to the sheet-type conductive member 11 and has a sheet-type conductive member insertion opening 32 used for inserting an end of the sheet type conductive member 11 and a housing-side slit (coated conductive wire holding portion) 33 used for inserting the coated conductive wire 21.

For convenience, the plane in which the sheet-type conductive member 11 extends is called "XY plane," the direction from the housing 31 toward the sheet-type conductive member 11 is called "+Y direction," and the direction being the thickness direction of the housing 31 and perpendicular to the XY plane is called "Z direction."

The −Y directional end of the sheet-type conductive member 11 is inserted into the sheet-type conductive member insertion opening 32 of the housing 31, and a tip end of the coated conductive wire 21 is, while extending in the Z direction, inserted in the housing-side slit 33 of the housing 31.

Figure 4:
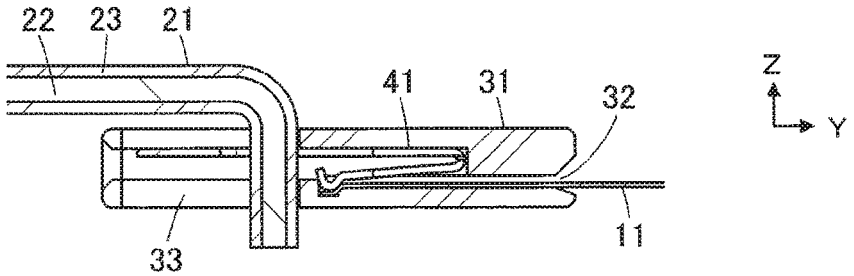
FIG. 4 is a cross-sectional view taken along line A-A in FIG. 2.
Figure 5:
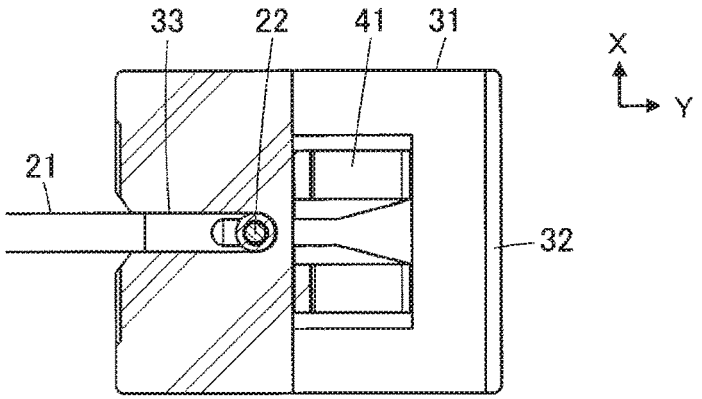
FIG. 5 is a cross-sectional view taken along line B-B in FIG. 3.

As shown in FIGS. 4 and 5, a pressure contact terminal 41 made of metal is accommodated in the housing 31. The pressure contact terminal 41 is electrically connected to the conductive pattern 13 of the sheet-type conductive member 11 and also to the conductor part 22 of the coated conductive wire 21. In other words, the conductor part 22 of the coated conductive wire 21 is electrically connected to the conductive pattern 13 of the sheet-type conductive member 11 via the pressure contact terminal 41 made of metal.

The housing 31 and the pressure contact terminal 41 constitute a coated conductive wire connecting member.

Figure 6:
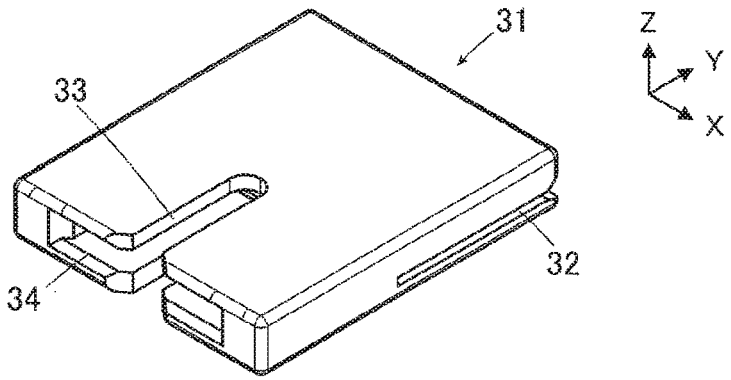
FIG. 6 is a perspective view showing a housing of a connecting member used in Embodiment 1.
Figure 7:
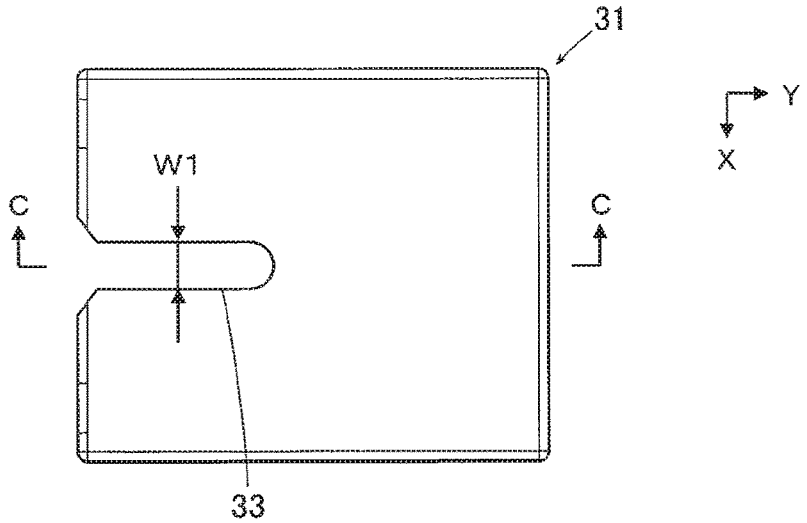
FIG. 7 is a plan view showing the housing of the connecting member used in Embodiment 1.
Figure 8:
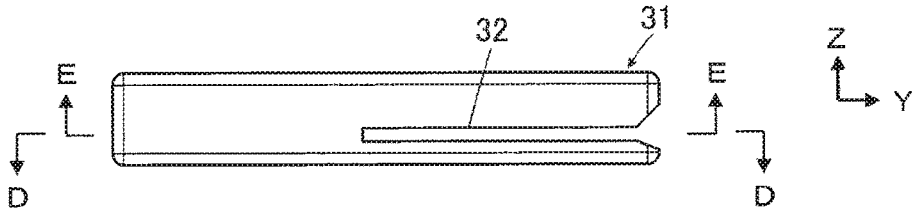
FIG. 8 is a side view showing the housing of the connecting member used in Embodiment 1.

The structure of the housing 31 is shown in FIGS. 6 to 8. The housing 31 in a flat plate shape is provided at its +Y directional end with the sheet-type conductive member insertion opening 32 that opens in three directions, i.e., the +Y, +X and −X directions, and at its −Y directional end with a pressure contact terminal insertion opening 34 that opens in the −Y direction.

The housing-side slit 33 extends in the +Y direction from the −Y directional end of the housing 31, opens in the −Y direction and communicates with the pressure contact terminal insertion opening 34. The housing-side slit 33 has a slit width W1 in the X direction that is equal to or slightly smaller than the diameter of the coated conductive wire 21.

Figure 9:
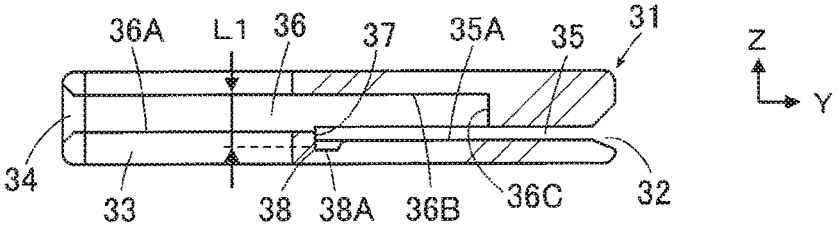
FIG. 9 is a cross-sectional view taken along line C-C in FIG. 7.

As shown in FIG. 9, the housing 31 is provided therein with a sheet-type conductive member accommodating portion 35 that communicates with the sheet-type conductive member insertion opening 32 and extends from the +Y directional end of the housing 31 to the middle part, in the Y direction, of the housing 31 along an XY plane. The housing 31 is also provided therein with a pressure contact terminal accommodating portion 36 that communicates with the pressure contact terminal insertion opening 34 and extends from the −Y directional end of the housing 31 to the vicinity of the +Y directional end of the housing 31 along an XY plane.

A part of the sheet-type conductive member accommodating portion 35 on the −Y direction side and a part of the pressure contact terminal accommodating portion 36 on the +Y direction side overlap each other in the Z direction, and the sheet-type conductive member accommodating portion 35 and the pressure contact terminal accommodating portion 36 communicate with each other in their overlapping part to integrally form a space.

The bottom (inner wall surface) 35A of the sheet-type conductive member accommodating portion 35 on the −Z direction side is situated beyond, in the −Z direction, the bottom 36A of the pressure contact terminal accommodating portion 36 on the −Z direction side, whereby a step portion 37 is formed at the −Y directional end of the sheet-type conductive member accommodating portion 35, i.e., in the communicating part where the sheet-type conductive member accommodating portion 35 and the pressure contact terminal accommodating portion 36 communicate with each other.

A groove 38 recessed in the −Z direction is formed in the bottom 35A of the sheet-type conductive member accommodating portion 35 at the −Y directional end thereof in a position adjacent to the step portion 37.

Figure 10:
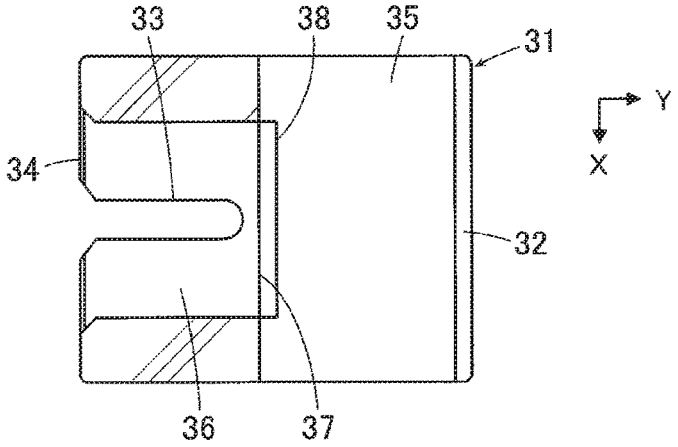
FIG. 10 is a cross-sectional view taken along line D-D in FIG. 8.

The sheet-type conductive member insertion opening 32 formed at the +Y directional end of the housing 31 opens in the three directions of +Y, +X and −X directions, and as shown in FIG. 10, the sheet-type conductive member accommodating portion 35 communicating with the sheet-type conductive member insertion opening 32 extends across the entire width of the housing 31 in the X direction. That is to say, the sheet-type conductive member accommodating portion 35 opens in the three directions of +Y, +X and −X directions. Accordingly, even when the sheet-type conductive member 11 extends for a longer distance than the housing 31 in the X direction, through the insertion of the sheet-type conductive member 11 from the sheet-type conductive member insertion opening 32 toward the −Y direction, the sheet-type conductive member 11 is accommodated in the sheet-type conductive member accommodating portion 35 so as to reach the −Y directional end of the sheet-type conductive member accommodating portion 35 where the step portion 37 is present.

FIG. 10 shows how the pressure contact terminal accommodating portion 36 communicating with the pressure contact terminal insertion opening 34 formed at the −Y directional end of the housing 31 communicates with the sheet-type conductive member accommodating portion 35 via the step portion 37.

The step portion 37 and the groove 38 extend in the X direction throughout the X directional range across which the pressure contact terminal accommodating portion 36 is present.

Figure 11:
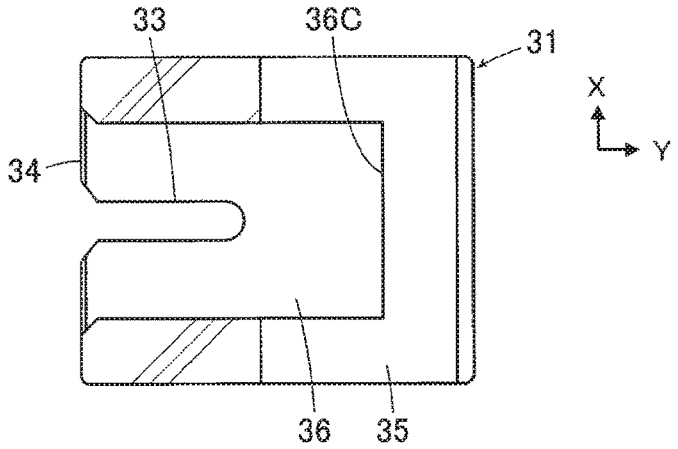
FIG. 11 is a cross-sectional view taken along line E-E in FIG. 8.

As shown in FIG. 11, the pressure contact terminal accommodating portion 36 opens only in the −Y direction, and the opposite ends of the pressure contact terminal accommodating portion 36 in the X direction are closed by the housing 31. The +Y directional end of the pressure contact terminal accommodating portion 36 is also closed by the housing 31, and an abutment surface 36C extending along an XZ plane is formed at this +Y directional end of the pressure contact terminal accommodating portion 36. A part of the pressure contact terminal accommodating portion 36 extending from the middle part, in the Y direction, of the portion 36 to the +Y directional end thereof overlies the +Z direction side of the sheet-type conductive member accommodating portion 35.

Figure 12:
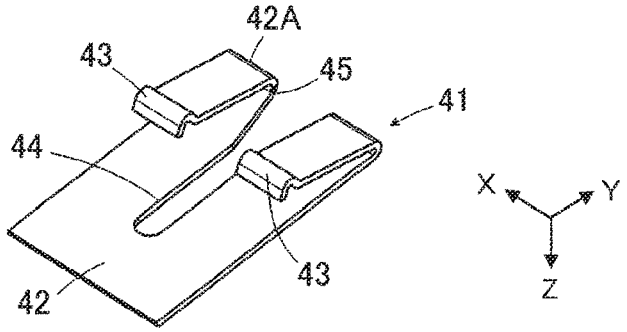
FIG. 12 is a perspective view showing a pressure contact terminal of the connecting member used in Embodiment 1.
Figure 13:
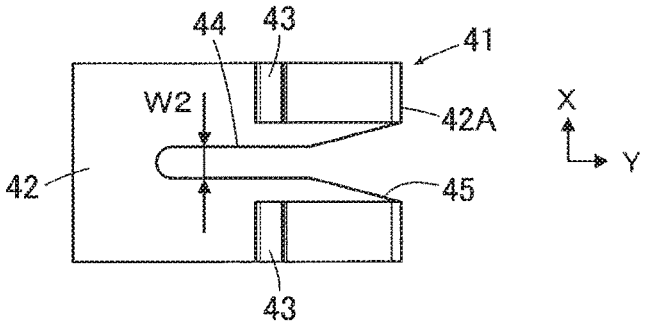
FIG. 13 is a bottom view showing the pressure contact terminal of the connecting member used in Embodiment 1.
Figure 14:
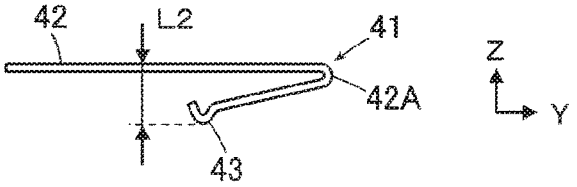
FIG. 14 is a side view showing the pressure contact terminal of the connecting member used in Embodiment 1.

The structure of the pressure contact terminal 41 is shown in FIGS. 12 to 14. The pressure contact terminal 41 is formed from a single metal sheet and includes a flat portion 42 extending along an XY plane and two spring contacts 43. The two spring contacts 43 are formed from an end portion of the metal sheet that is bent from the +Y directional end 42A of the flat portion 42 toward the −Y direction and the −Z direction, and disposed to be elastically deformable in the Z direction perpendicular to the flat portion 42. The two spring contacts 43 are arranged side by side in the X direction, and a terminal-side slit 44 is formed between those spring contacts 43 to extend from the +Y directional end 42A of the flat portion 42 toward the −Y direction.

The terminal-side slit 44 has a slit width W2 in the X direction that is slightly smaller than the diameter of the conductor part 22 of the coated conductive wire 21.

The +Y directional end of the terminal-side slit 44 constitutes a slit opening end 45 communicating with the terminal-side slit 44 and opening in the +Y direction. The slit opening end 45 has a width in the X direction that is larger than the slit width W2 of the terminal-side slit 44 and has a tapered shape with its width in the X direction increasing in the +Y direction.

The flat portion 42 has a width in the X direction that is slightly smaller than the width, in the X direction, of the pressure contact terminal accommodating portion 36 of the housing 31. In a natural state where no force is exerted on either of the spring contacts 43, a distance L2 in the Z direction from the surface of the flat portion 42 on the +Z direction side to the ends of the two spring contacts 43 is set to be larger than a distance L1 in the Z direction from a ceiling surface 36B of the pressure contact terminal accommodating portion 36 of the housing 31 on the +Z direction side to the bottom 38A of the groove 38 on the −Z direction side, which is shown in FIG. 9.

Now, the method of connecting the coated conductive wire 21 to the sheet-type conductive member 11 using the coated conductive wire connecting member constituted of the housing 31 and the pressure contact terminal 41 is described.

Figure 15:
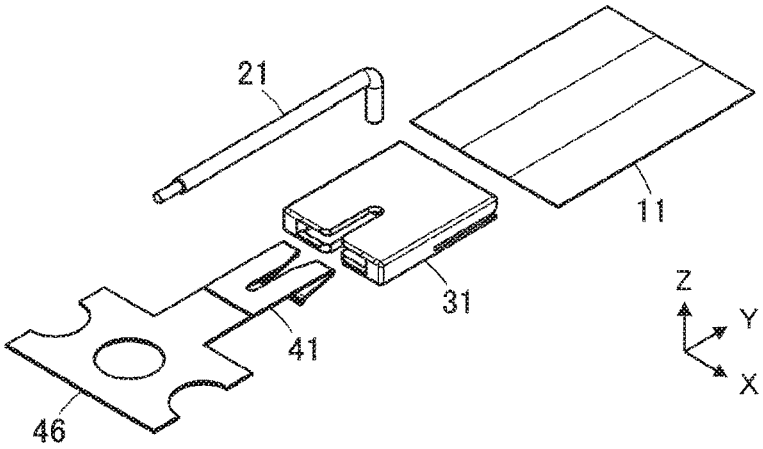
FIG. 15 is a perspective view showing the state where a sheet-type conductive member, a coated conductive wire and the pressure contact terminal are positioned with respect to the housing.

First, as shown in FIG. 15, the sheet-type conductive member 11, the coated conductive wire 21, and the pressure contact terminal 41 joined to a carrier 46 are relatively positioned with respect to the housing 31. At this time, the sheet-type conductive member 11 is positioned on the +Y direction side of the housing 31 with the conductive pattern 13 formed on the surface of the sheet body 12 facing in the +Z direction. The coated conductive wire 21 is positioned on the +Z direction side of the housing 31, and the pressure contact terminal 41 is positioned on the −Y direction side of the housing 31.

Figure 16:
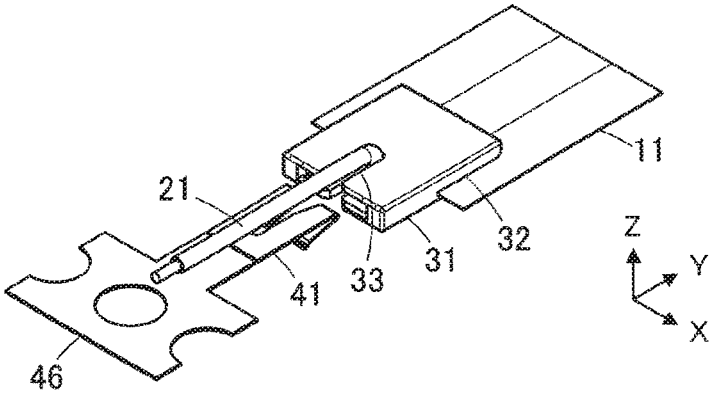
FIG. 16 is a perspective view showing the state where the sheet-type conductive member and the coated conductive wire are inserted in the housing.

As shown in FIG. 16, an end of the sheet-type conductive member 11 is inserted into the sheet-type conductive member insertion opening 32 of the housing 31 from the +Y direction toward the −Y direction, and the tip end of the coated conductive wire 21 is inserted into the housing-side slit 33 of the housing 31 from the +Z direction toward the −Z direction.

Figure 17:
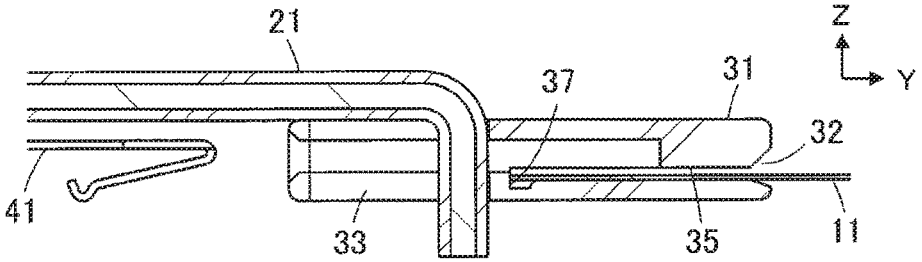
FIG. 17 is a cross-sectional side view showing the state where the sheet-type conductive member and the coated conductive wire are inserted in the housing.

Consequently, as shown in FIG. 17, the −Y directional end of the sheet-type conductive member 11 is accommodated in the sheet-type conductive member accommodating portion 35 so as to abut on the step portion 37 of the housing 31, and the tip end of the coated conductive wire 21 penetrates through the housing 31 in the Z direction at the +Y directional end of the housing-side slit 33 of the housing 31.

Since the housing-side slit 33 has the slit width W1 in the X direction that is equal to or slightly smaller than the diameter of the coated conductive wire 21, the tip end of the coated conductive wire 21 inserted in the housing-side slit 33 is held while penetrating through the housing 31.

Figure 18:
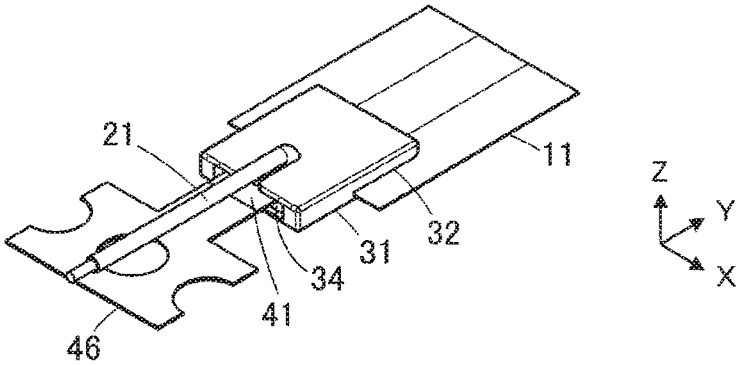
FIG. 18 is a perspective view showing the early stage of insertion of the pressure contact terminal into the housing.
Figure 19:
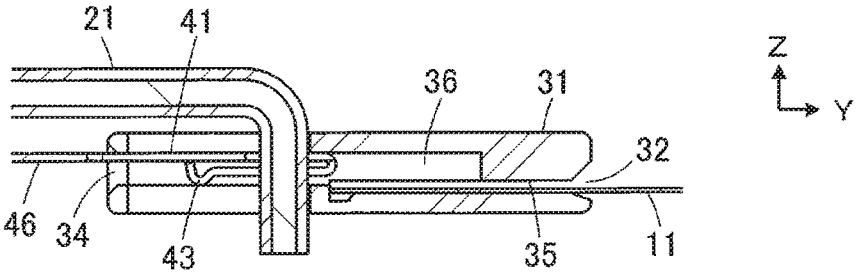
FIG. 19 is a cross-sectional side view showing the early stage of insertion of the pressure contact into the housing.

Next, as shown in FIG. 18, the pressure contact terminal 41 jointed to the carrier 46 is inserted into the pressure contact terminal insertion opening 34 of the housing 31 from the −Y direction toward the +Y direction. At this time, as shown in FIG. 19, the two spring contacts 43 are elastically deformed as being inserted into the pressure contact terminal insertion opening 34 of the housing 31, and in this state, the pressure contact terminal 41 is thrust into the pressure contact terminal accommodating portion 36 of the housing 31.

Figure 20:
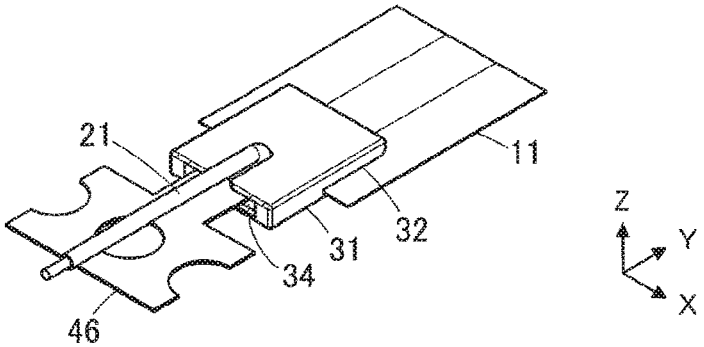
FIG. 20 is a perspective view showing the state where the pressure contact terminal is completely inserted in the housing.
Figure 21:
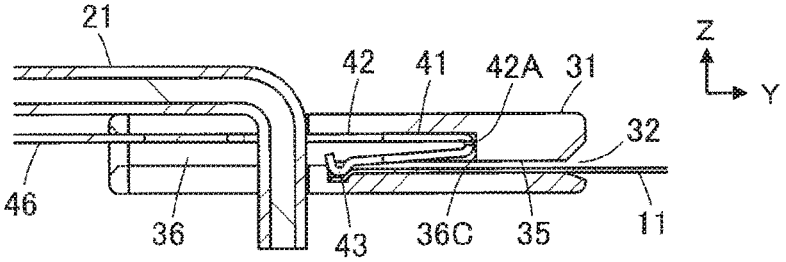
FIG. 21 is a cross-sectional side view showing the state where the pressure contact terminal is completely inserted in the housing.

As shown in FIGS. 20 and 21, the pressure contact terminal 41 is inserted into the housing 31 and thrust into the pressure contact terminal accommodating portion 36 until the +Y directional end 42A of the flat portion 42 abuts on the abutment surface 36C at the +Y directional end of the pressure contact terminal accommodating portion 36 of the housing 31. When the +Y directional end 42A of the flat portion 42 abuts on the abutment surface 36C of the housing 31, the insertion of the pressure contact terminal 41 with respect to the housing 31 is completed. Thus, the pressure contact terminal 41 is accommodated in the pressure contact terminal accommodating portion 36 of the housing 31.

Figure 22:
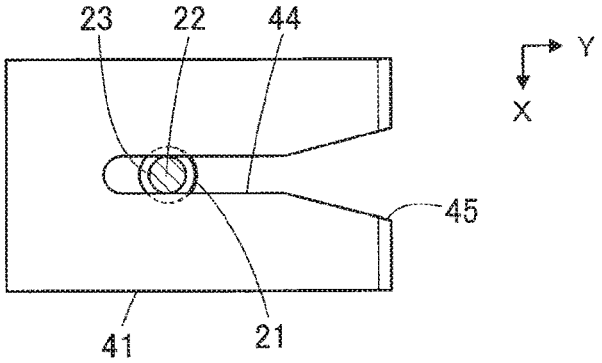
FIG. 22 is a plan view showing the state where the coated conductive wire is inserted in a terminal-side slit of the pressure contact terminal.

Since the pressure contact terminal 41 is, with its slit opening end 45 being the front end, accommodated in the pressure contact terminal accommodating portion 36 through the pressure contact terminal insertion opening 34 of the housing 31, the tip end of the coated conductive wire 21 inserted and held by the housing-side slit 33 of the housing 31 is to be inserted in the terminal-side slit 44 from the slit opening end 45 of the pressure contact terminal 41. The terminal-side slit 44 has the slit width W2 in the X direction that is slightly smaller than the diameter of the conductor part 22 of the coated conductive wire 21; therefore, as shown in FIG. 22, the insulator part 23 covering the outer periphery of the conductor part 22 of the coated conductive wire 21 is cut and torn by the edge of the terminal-side slit 44 of the pressure contact terminal 41, so that the pressure contact terminal 41 comes into contact with the conductor part 22 of the coated conductive wire 21 to establish their electrical connection.

Figure 23:
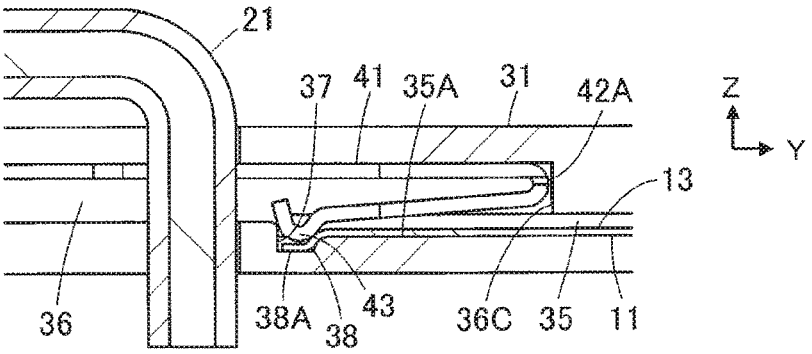
FIG. 23 is a cross-sectional side view showing a part where a spring contact of the pressure contact terminal and the sheet-type conductive member are connected to each other in Embodiment 1.

As shown in FIG. 23, when the pressure contact terminal 41 is thrust into the pressure contact terminal accommodating portion 36 of the housing 31 until the +Y directional end 42A of the flat portion 42 abuts on the abutment surface 36C, the ends of the two elastically deformed spring contacts 43 pass over, in the +Y direction, the step portion 37 formed in the communicating part between the pressure contact terminal accommodating portion 36 and the sheet-type conductive member accommodating portion 35 of the housing 31 and reach the inside of the sheet-type conductive member accommodating portion 35. As a consequence, the sheet-type conductive member 11 accommodated in the sheet-type conductive member accommodating portion 35 is elastically pressed, in the −Z direction, against the bottom 35A of the sheet-type conductive member accommodating portion 35 by the two spring contacts 43.

Since the conductive pattern 13 is disposed on the surface of the sheet-type conductive member 11 on the +Z direction, the ends of the two spring contacts 43 come into contact with the conductive pattern 13 of the sheet-type conductive member 11, whereby the pressure contact terminal 41 is electrically connected to the conductive pattern 13 of the sheet-type conductive member 11.

In other words, the conductor part 22 of the coated conductive wire 21 is electrically connected to the conductive pattern 13 of the sheet-type conductive member 11 via the pressure contact terminal 41 made of metal.

Since the groove 38 is formed in the bottom 35A of the sheet-type conductive member accommodating portion 35 at the −Y directional end thereof to be adjacent to the step portion 37, the sheet-type conductive member 11 is sandwiched between a shoulder of the groove 38 and the spring contacts 43 and held thereby, thus establishing the electrical connection between the spring contacts 43 and the conductive pattern 13 of the sheet-type conductive member 11.

Even if the groove 38 is not present, since the spring contacts 43 elastically press the sheet-type conductive member 11 against the bottom 35A of the sheet-type conductive member accommodating portion 35, the spring contacts 43 and the conductive pattern 13 of the sheet-type conductive member 11 are electrically connected to each other; however, owing to such a configuration that the sheet-type conductive member 11 is sandwiched between the shoulder of the groove 38 and the spring contacts 43, the electrical connection can have improved reliability, and a holding force against the sheet-type conductive member 11 can be improved.

After the pressure contact terminal 41 joined to the carrier 46 is thus inserted into the housing 31, the carrier 46 is disjoined from the pressure contact terminal 41 to thereby obtain the coated conductive wire connecting structure shown in FIGS. 1 to 3.

For instance, a dividing groove is formed in advance between the carrier 46 and the pressure contact terminal 41 to separate them, and when, with respect to the pressure contact terminal 41 inserted in the housing 31, the carrier 46 is folded along the dividing groove, the carrier 46 can be disjoined from the pressure contact terminal 41.

Thus, with the end of the sheet-type conductive member 11 being accommodated in the sheet-type conductive member accommodating portion 35 through the sheet-type conductive member insertion opening 32 of the housing 31, and with the end of the coated conductive wire 21 being inserted and held by the housing-side slit 33 of the housing 31, the pressure contact terminal 41 is inserted from the pressure contact terminal insertion opening 34 of the housing 31 to be accommodated in the pressure contact terminal accommodating portion 36; with this single action alone, the conductor part 22 of the coated conductive wire 21 can readily be electrically connected to the conductive pattern 13 of the sheet-type conductive member 11 via the pressure contact terminal 41.

While, in Embodiment 1 above, the pressure contact terminal 41 has the two spring contacts 43 arranged on the opposite sides of the terminal-side slit 44, the invention is not limited thereto, and the pressure contact terminal 41 may have only a single spring contact 43. When the pressure contact terminal 41 has the two spring contacts 43 as in Embodiment 1, however, this ensures more reliable electrical connection of the pressure contact terminal 41 with the conductive pattern 13 of the sheet-type conductive member 11.

While, in Embodiment 1 above, the housing 31 has the housing-side slit 33 as the coated conductive wire holding portion, the invention is not limited thereto, and the housing 31 may have a hole that receives the coated conductive wire 21 therein, as the coated conductive wire holding portion.

Embodiment 2

In Embodiment 1, the housing 31 has the groove 38 recessed in the −Z direction in the bottom 35A of the sheet-type conductive member accommodating portion 35 at the −Y directional end thereof, and the sheet-type conductive member 11 is sandwiched between the shoulder of the groove 38 and the spring contacts 43 and held thereby; however, the invention is not limited thereto.

Figure 24:
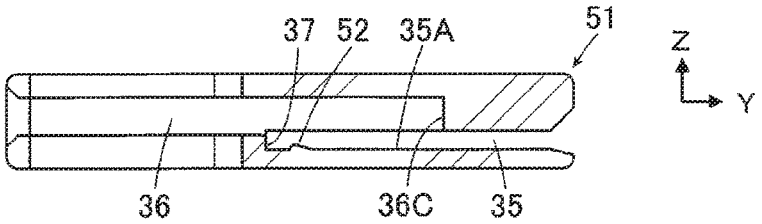
FIG. 24 is a cross-sectional side view showing a housing of a connecting member used in Embodiment 2.

The structure of a housing 51 used in a coated conductive wire connecting structure according to Embodiment 2 is shown in FIG. 24. The housing 51 is configured such that, in place of the groove 38, a projection 52 projecting in the +Z direction is formed on the bottom 35A of the sheet-type conductive member accommodating portion 35 at the −Y directional end thereof in the housing 31 in Embodiment 1, and except that, the structure of the housing 51 is the same as that of the housing 31 in Embodiment 1.

The housing 51 in Embodiment 2 is used along with the pressure contact terminal 41 in Embodiment 1.

Figure 25:
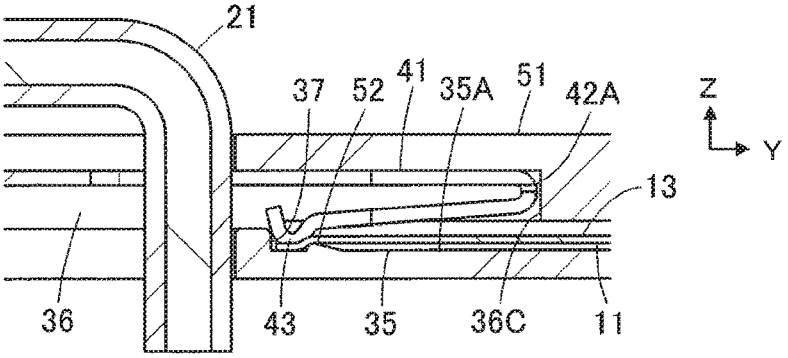
FIG. 25 is a cross-sectional side view showing a part where the spring contact of the pressure contact terminal and the sheet-type conductive member are connected to each other in Embodiment 2.

When the insertion of the pressure contact terminal 41 into the housing 51 is completed so that the pressure contact terminal 41 is accommodated in the pressure contact terminal accommodating portion 36 of the housing 51, as shown in FIG. 25, the ends of the elastically deformed spring contacts 43 are positioned beyond the step portion 37 of the housing 51 in the +Y direction, and the sheet-type conductive member 11 is sandwiched and held between the top of the projection 52 formed on the bottom 35A of the sheet-type conductive member accommodating portion 35 and the spring contacts 43, whereby the spring contacts 43 and the conductive pattern 13 of the sheet-type conductive member 11 are electrically connected to each other.

The use of the housing 51 having the projection 52 as above also makes it possible to improve the reliability of the electrical connection and a holding force against the sheet-type conductive member 11, as with Embodiment 1.

Embodiment 3

Figure 26:
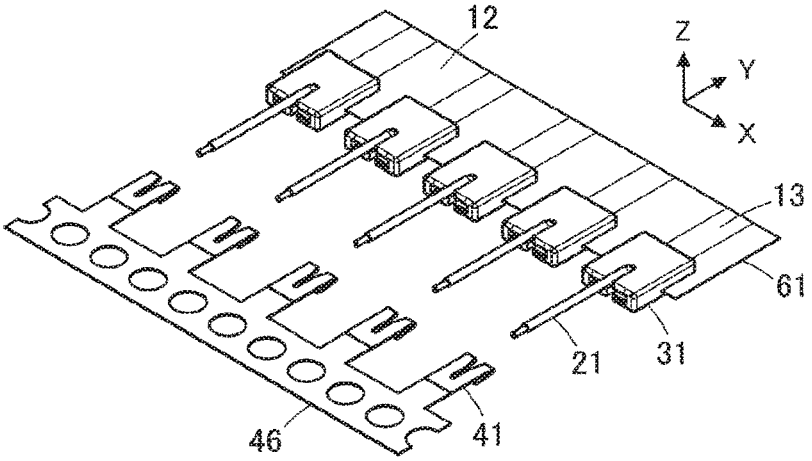
FIG. 26 is a perspective view showing the state where a sheet-type conductive member and coated conductive wires are inserted in respective housings in Embodiment 3.

As shown in FIG. 26, the present invention can also be applied to a sheet-type conductive member 61 having plural conductive patterns 13 formed on the surface of the insulating sheet body 12.

Figure 27:
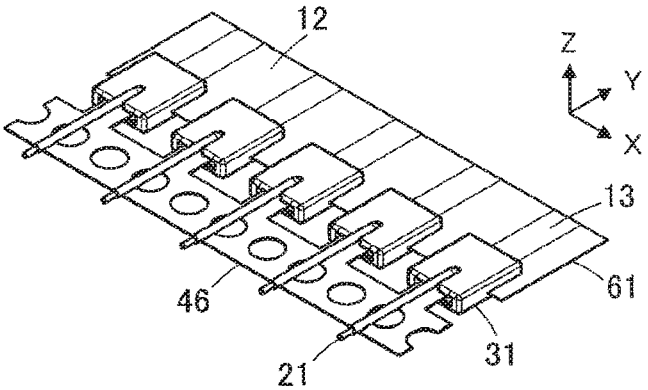
FIG. 27 is a perspective view showing the state where pressure contact terminals are inserted in the respective housings in Embodiment 3.

The −Y directional ends of the conductive patterns 13 on the sheet-type conductive member 61 are separately accommodated in sheet-type conductive member accommodating portions 35 of housings 31 corresponding to the conductive patterns 13, coated conductive wires 21 are separately held by coated conductive wire holding portions of the housings 31, and in this state, as shown in FIG. 27, pressure contact terminals 41 are separately accommodated in pressure contact terminal accommodating portions 36 of the housings 31.

The pressure contact terminals 41 are joined to a single carrier 46. By thrusting the carrier 46 in the +Y direction with respect to the housings 31, the pressure contact terminals 41 can readily be inserted into the housings 31 at once.

As a result, the conductor parts 22 of the coated conductive wires 21 are electrically connected to the conductive patterns 13 of the sheet-type conductive member 61 via the pressure contact terminals 41, correspondingly.

Figure 28:
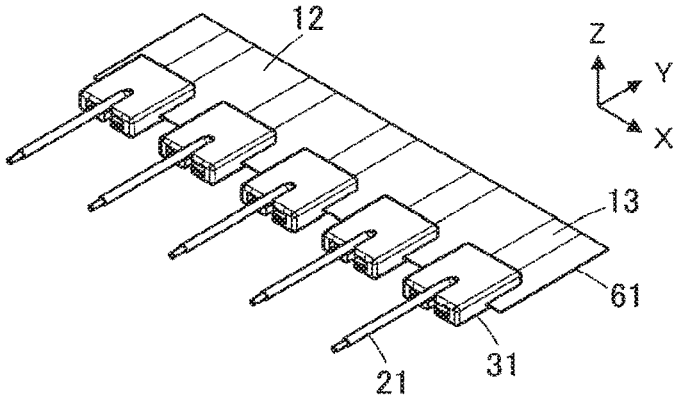
FIG. 28 is a perspective view showing a coated conductive wire connecting structure according to Embodiment 3.
Figure 29:
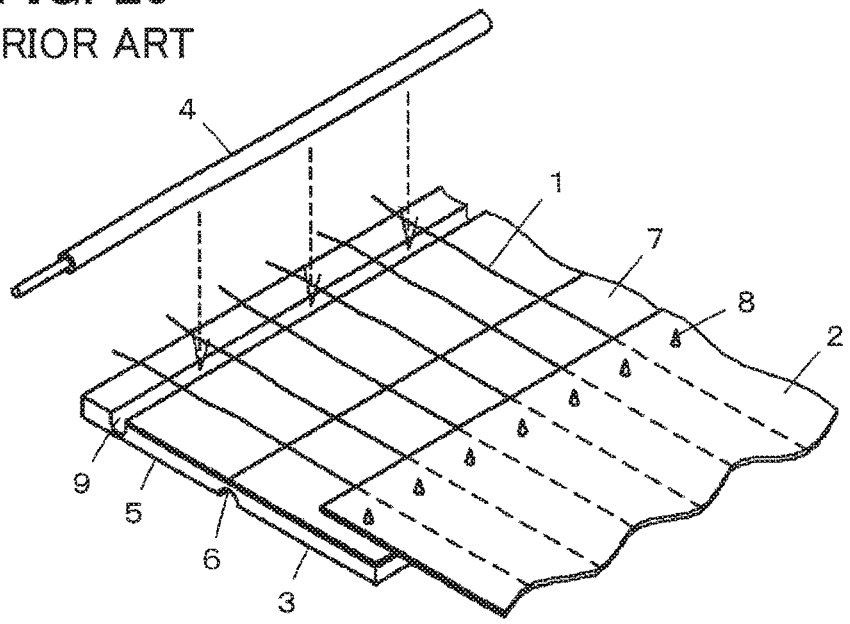
FIG. 29 PRIOR ART
FIG. 29 is a perspective view showing a connecting member used in a conventional, coated conductive wire connecting structure.
Figure 30:
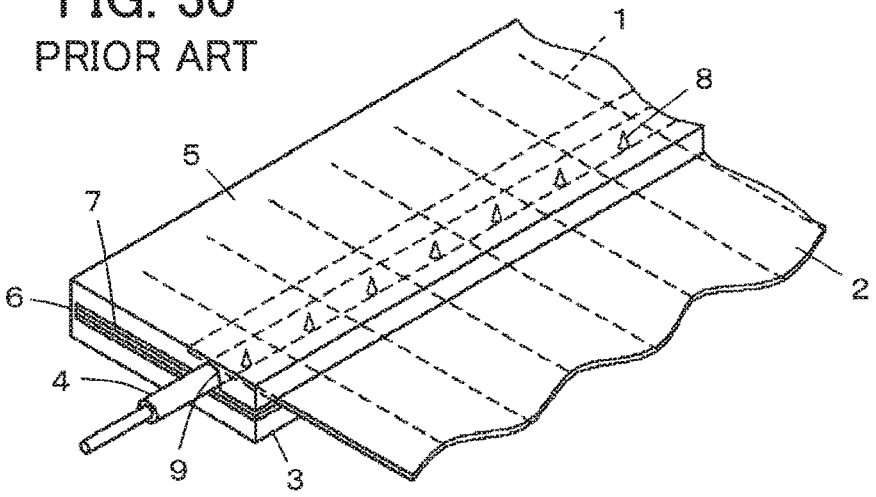
FIG. 30 PRIOR ART
FIG. 30 is a perspective view showing the conventional, coated conductive wire connecting structure.

Thereafter, the carrier 46 is disjoined from the pressure contact terminals 41, thus obtaining the connecting structure between the coated conductive wires 21 and the sheet-type conductive members 61 as shown in FIG. 28.

This procedure only involves thrusting the pressure contact terminals 41 in the +Y direction, and even when the arrangement pitch of the conductive patterns 13 is small in the sheet-type conductive member 61, the coated conductive wires 21 can readily be connected to the sheet-type conductive members 61 by inserting the pressure contact terminals 41 into the housings 31 at once.

Even when the housings 31 are replaced by housings 51 described in Embodiment 2, it is possible to obtain the connecting structure between the coated conductive wires 21 and the sheet-type conductive members 61.

What is claimed is:

1. A coated conductive wire connecting method for connecting a coated conductive wire having a conductor part covered with an insulating part to a sheet-type conductive member, the method comprising:

placing an end of the sheet-type conductive member such that the end of the sheet-type conductive member is accommodated in a sheet-type conductive member accommodating portion in an insulating housing through a sheet-type conductive member insertion opening formed at one end of the housing;

holding the coated conductive wire by a coated conductive wire holding portion disposed on another end side of the housing; and placing a pressure contact terminal made of metal and including a flat portion which extends parallel to the sheet-type conductive member and in which a terminal-side slit is formed and a spring contact disposed to be elastically deformable in a direction perpendicular to the flat portion, such that the pressure contact terminal is accommodated in a pressure contact terminal accommodating portion communicating with the sheet-type conductive member accommodating portion within the housing, through a pressure contact terminal insertion opening formed at the another end of the housing, whereupon the coated conductive wire held by the coated conductive wire holding portion is inserted into the terminal-side slit, and an edge of the terminal-side slit cuts and tears the insulating part of the coated conductive wire to electrically connect the pressure contact terminal to the conductor part, while the spring contact elastically deformed passes over a step portion formed in a communicating part between the pressure contact terminal accommodating portion and the sheet-type conductive member accommodating portion within the housing and elastically presses the sheet-type conductive member against an inner wall surface of the sheet-type conductive member accommodating portion to electrically connect the pressure contact terminal to the sheet-type conductive member.

2. A coated conductive wire connecting structure for connecting a coated conductive wire having a conductor part covered with an insulating part to a sheet-type conductive member, the structure comprising:

an insulating housing in which a sheet-type conductive member insertion opening is formed at one end of the housing, a pressure contact terminal insertion opening is formed at another end of the housing and a sheet-type conductive member accommodating portion communicating with the sheet-type conductive member insertion opening and a pressure contact terminal accommodating portion communicating with the pressure contact terminal insertion opening are formed inside the housing, the sheet-type conductive member accommodating portion and the pressure contact terminal accommodating portion communicating with each other, a step portion being formed in a communicating part between the sheet-type conductive member accommodating portion and the pressure contact terminal accommodating portion, a coated conductive wire holding portion for holding the coated conductive wire being disposed on a side of the another end of the housing; and a pressure contact terminal made of metal and including a flat portion in which a terminal-side slit is formed and which extends parallel to the sheet-type conductive member and a spring contact disposed to be elastically deformable in a direction perpendicular to the flat portion, wherein an end of the sheet-type conductive member is accommodated in the sheet-type conductive member accommodating portion through the sheet-type conductive member insertion opening of the housing, wherein the coated conductive wire is held by the coated conductive wire holding portion of the housing, wherein the pressure contact terminal is accommodated in the pressure contact terminal accommodating portion through the pressure contact terminal insertion opening of the housing with the spring contact being elastically deformed, wherein the insulating part of the coated conductive wire inserted into the terminal-side slit of the pressure contact terminal is cut and torn by an edge of the terminal-side slit, whereby the pressure contact terminal is electrically connected to the conductor part, and wherein the sheet-type conductive member accommodated in the sheet-type conductive member accommodating portion is elastically pressed against an inner wall surface of the sheet-type conductive member accommodating portion by the spring contact positioned beyond the step portion in the housing, whereby the pressure contact terminal is electrically connected to the sheet-type conductive member.

3. The coated conductive wire connecting structure according to claim 2, wherein the sheet-type conductive member has a plurality of conductive patterns corresponding to a plurality of the coated conductive wires, wherein the coated conductive wire connecting structure comprises a plurality of the housings corresponding to the plurality of conductive patterns and a plurality of the pressure contact terminals corresponding to the plurality of the housings, wherein an end of each of the plurality of conductive patterns of the sheet-type conductive member is accommodated in the sheet-type conductive member accommodating portion of the corresponding housing, wherein each of the plurality of the coated conductive wires is held by the coated conductive wire holding portion of the corresponding housing, and wherein each of the plurality of the pressure contact terminals is accommodated in the pressure contact terminal accommodating portion of the corresponding housing.

4. A coated conductive wire connecting member for connecting a coated conductive wire having a conductor part covered with an insulating part to a sheet-type conductive member, the member comprising:

an insulating housing in which a sheet-type conductive member insertion opening is formed at one end of the housing, a pressure contact terminal insertion opening is formed at another end of the housing, and a sheet-type conductive member accommodating portion communicating with the sheet-type conductive member insertion opening and a pressure contact terminal accommodating portion communicating with the pressure contact terminal insertion opening are formed inside the housing, the sheet-type conductive member accommodating portion and the pressure contact terminal accommodating portion communicating with each other, a step portion being formed in a communicating part between the sheet-type conductive member accommodating portion and the pressure contact terminal accommodating portion, a coated conductive wire holding portion for holding the coated conductive wire being disposed on a side of the another end of the housing; and a pressure contact terminal made of metal and including a flat portion in which a terminal-side slit is formed and which extends parallel to the sheet-type conductive member and a spring contact disposed to be elastically deformable in a direction perpendicular to the flat portion, the pressure contact terminal being configured to be accommodated in the pressure contact terminal accommodating portion through the pressure contact terminal insertion opening of the housing with the spring contact being elastically deformed, wherein, with an end of the sheet-type conductive member being accommodated in the sheet-type conductive member accommodating portion through the sheet-type conductive member insertion opening of the housing, and the coated conductive wire being held by the coated conductive wire holding portion of the housing, when the pressure contact terminal is accommodated in the pressure contact terminal accommodating portion, the coated conductive wire is inserted into the terminal-side slit of the pressure contact terminal, and the insulating part of the coated conductive wire is cut and torn by an edge of the terminal-side slit, whereby the pressure contact terminal is electrically connected to the conductor part, while the sheet-type conductive member accommodated in the sheet-type conductive member accommodating portion is elastically pressed against an inner wall surface of the sheet-type conductive member accommodating portion by the spring contact positioned beyond the step portion in the housing, whereby the pressure contact terminal is electrically connected to the sheet-type conductive member.

5. The coated conductive wire connecting member according to claim 4, wherein the pressure contact terminal has a slit opening end communicating with the terminal-side slit, wherein the spring contact is disposed adjacent to the slit opening end, and wherein the pressure contact terminal is accommodated in the pressure contact terminal accommodating portion through the pressure contact terminal insertion opening of the housing with the slit opening end as a front end.

6. The coated conductive wire connecting member according to claim 4, wherein the housing has a groove or a projection formed on the inner wall surface of the sheet-type conductive member accommodating portion against which the sheet-type conductive member is elastically pressed by the spring contact of the pressure contact terminal, and wherein the sheet-type conductive member is sandwiched between a shoulder of the groove or a top of the projection and the spring contact.

7. The coated conductive wire connecting member according to claim 4, wherein the coated conductive wire holding portion is constituted of a housing-side slit or a hole that is formed in the housing and receives the coated conductive wire therein.

8. The coated conductive wire connecting member according to claim 4, wherein the pressure contact terminal is formed from one metal sheet, and wherein the spring contact is formed from an end portion of the one metal sheet that is bent.

9. The coated conductive wire connecting member according to claim 4, wherein the spring contact is disposed on each of opposite sides of the terminal-side slit.

* * * * *